United States Patent [19]

Stroede et al.

[11] Patent Number: 4,570,108

[45] Date of Patent: Feb. 11, 1986

[54] PROTECTION DEVICE FOR ELECTRICAL INCANDESCENT LAMPS

[76] Inventors: Ake Stroede, P1 3073, S-430 40 Särö; Lars Gunnarsson, P1 9251, S-439 00 Onsala, both of Sweden

[21] Appl. No.: 598,315

[22] PCT Filed: Mar. 5, 1983

[86] PCT No.: PCT/SE83/00273

§ 371 Date: Mar. 5, 1984

§ 102(e) Date: Mar. 5, 1984

[87] PCT Pub. No.: WO84/00463

PCT Pub. Date: Feb. 2, 1984

[30] Foreign Application Priority Data

Jul. 6, 1982 [SE] Sweden ..... 8204171
Dec. 13, 1982 [SE] Sweden ..... 8207101

[51] Int. Cl.[4] ..... H05B 37/02

[52] U.S. Cl. ..... 315/360; 315/200 A; 315/208; 315/307

[58] Field of Search ..... 315/307, 360, 200 R, 315/208, 194, 199

[56] References Cited

U.S. PATENT DOCUMENTS 2,295,297 9/1942 Schneider ..... 315/360
3,731,182 5/1973 Hirono et al. ..... 315/307
3,898,516 8/1975 Nakasone ..... 315/194
4,008,416 2/1977 Nakasone ..... 315/194
4,082,961 4/1978 Genuit ..... 315/194
4,206,385 6/1980 Wisbey ..... 315/360
4,358,717 11/1982 Elliott ..... 315/308
4,395,661 7/1983 Becker ..... 315/360
4,459,515 7/1984 Smith ..... 315/194

FOREIGN PATENT DOCUMENTS 2924331 12/1980 Fed. Rep. of Germany .

*Primary Examiner*—Harold Dixon

[57] ABSTRACT

Protection device for electrical incandescent lamps provided with elements which upon switching on electric voltage limit the current strength during a switching-on interval. The device further includes a control unit with a controllable current valve (10) and timing means (19, 20) for the control of the current through the lamp upon switching-on so that a delayed increase of current is obtained from zero to a chosen operating current over a predetermined time interval.

4 Claims, 10 Drawing Figures

PROTECTION DEVICE FOR ELECTRICAL INCANDESCENT LAMPS

TECHNICAL FIELD

The present invention relates to a protection device for electrical incandescent lamps which are provided for operation at a prescribed operating voltage, including elements which upon switching on electric voltage limit the current strength during a switching on interval.

BACKGROUND

Conventional electrical installations for incandescent lamps usually miss protection devices for the filaments of the incandescent lamps. They will upon switching on the light be subjected to a surge current which considerably exceeds the normal operation current. The size of the surge current depends on where the switching on the current takes place by time along the sinus curve of the supply current and can amount to fourteen times the normal operation current. Even though the switching on takes place in the zero-point of the sinus curve, the operating current will be exceeded with a factor of four in connection with conventional installations. This depends on the fact that the resistance of the filament is substantially proportional to the absolute temperature. The resistance of a cold filament is ten times less than the filament at normal operating temperature, involving said surge current, which strongly limits the life time of conventional incandescent lamps. In the filament a gasous process takes place resulting in a consumption of the material of the filament, usually containing tungsten, until a brakage occurs. It has been stated that this process is accelerated in connection with switching on by means of conventional technique because of said surge current.

Attempts have been made to prolong the life time by protecting incandescent lamps against such surge currents by means of a thermistor with a negative temperature coefficent which is connected in series with the filament. Such a proposal is apparent from the U.S. Pat. No. 3,975,658. However, this known solution is provided with disadvantages. A thermistor consumes power which reduces the light with for example up to 8%. Furthermore, it has appeared that thermistors per se will be heated relatively fast and therefore the operating current will be exceeded with 3–4 times despite this known protection device. The disadvantageous surge current in connection with switching on will consequently not be limited but only reduced and will furthermore vary in size depending on where along the sinus curve the switching on occurs.

Consequently it can be stated that hitherto known solutions have not in a satisfactory manner solved the problem with the limited life time of incandescent lamps.

TECHNICAL PROBLEM

The object of the present invention is to accomplish a protection device, which in an efficient manner and with a minimum of power consumption prolongs the life time of the filament in an incandescent lamp.

THE SOLUTION

Said object will be attained by means of a protection device according to the present invention, which is characterized therein that said device includes a control unit with at least one controllable current valve and timing means for the control of the current through the lamp upon switching on so that a delayed increase of current is obtained from zero to a chosen operating current over a predetermined time interval involving that the voltage over the lamp during at least said time interval is brought to be below the operating voltage.

BRIEF DESCRIPTION OF DRAWINGS

The invention will in the following further be described by means of some embodiments referring to the accompanying drawings, in which.

BEST MODE OF CARRYING OUT THE INVENTION

Figure 1:
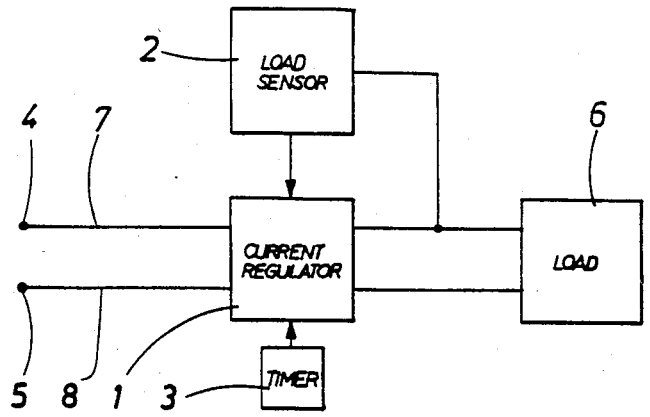
FIG. 1 shows a block diagram over the protection device in a first embodiment.

The protection device according to the first embodiment, shown in FIG. 1 is substantially comprising a current regulating device 1, a load sensing device 2 and a timing device 3. The protection device is connected between the voltage supply, to which the device is connected by means of two connecting points 4, 5, and a load 6 in the form of an incandescent lamp with filaments. The current feed occurs by means of two electrical feeding conductors 7, 8, by means of which the supply current is fed through the filament of the incandescent lamp. Usually the voltage supply is an alternating current with a voltage of 220 V and 50 Hz. The current regulating device 1 can in accordance with the example as shown in FIG. 1 be placed either in series with the load, i.e. the incandescent lamp 6, or in parallel with the lamp.

The main function of the protection device is consequently to protect the lamp by eliminating the surge current which in other cases arises in connection with switching on the light. However, further protection functions are involved, which will be described.

The load sensing device 2 is arranged to secure this further protection by sensing the load condition by for example sensing the current strength in the current feed to the load and to control the current regulating device 1 in dependance of the sensed current strength. In this way changes in resistance at the load 6 is sensed and the current regulating device 1 is controlled, if the resistance of the load is changed to fall outside a certain predetermined interval in such a way that when the resistance is outside said interval it is arranged that the current feed to the load will be interrupted. In this way the watch of the two most common extreme cases will be accomplished, namely when the load is short circuited or removed, which involves a high degree security. At short circuit i.e. when the resistance is zero, it is prevented that a connected installation will be damaged and accidents occur because of a too high current strength in the feeding conductors and when the lamp is removed, i.e. an infinite resistance, hereby persons are protected, for example children, from accidents because of a contact with free parts being under tension. The upper limit for the resistance interval is chosen so, that the current feed to the connectors of the load is interrupted, even though a person with any part of its body bridges the two connectors in for example a lamp holder, involving that the resistance will be reduced, but still relatively high.

By means of the timing device 3 the above mentioned injurious surge current is prevented by means of time control of the current regulating device 1 so, that current strength and consequently also the voltage over the lamp will be successively increased during a predetermined time interval up to a normal current-and voltage level, which further will be described below.

Figure 2:
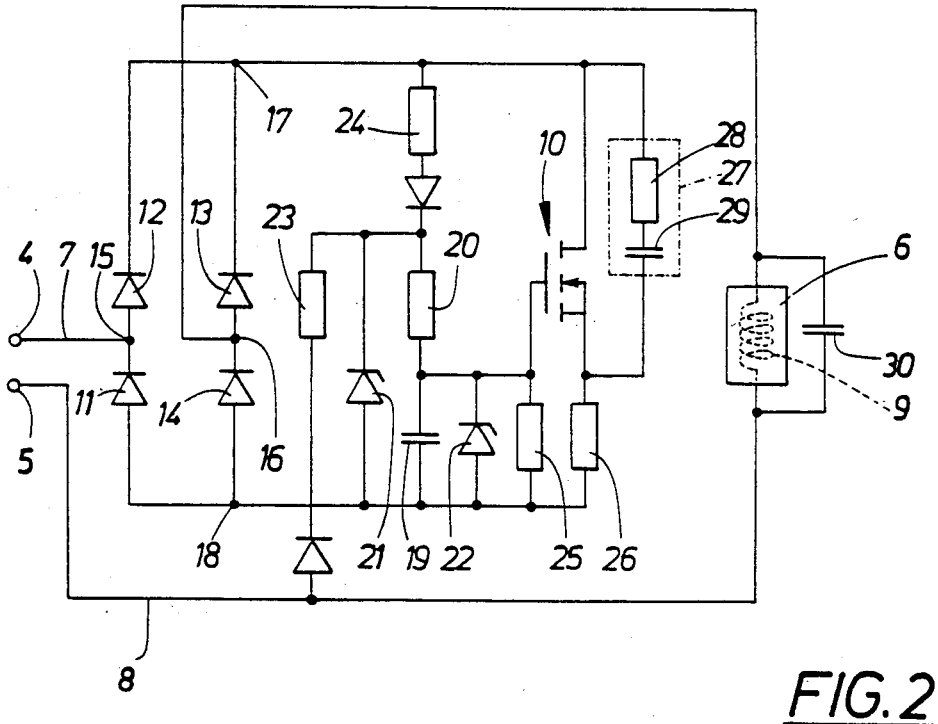
FIG. 2 shows a coupling diagram over a protection device in a second, somewhat simplified embodiment.

With reference to FIG. 2 the design of the simplified second embodiment will be described with reference to the most essential components. From the diagram it is apparent that the current regulating device is connected in series with the lamp 6, i.e. its filament 9, and has as an active component 10 an electronically control current valve in the form of a power transistor, which in the shown example is of the type MOS FET field effect transistor IRF 330. The current regulating device is in series with the lamp 6 by means of a rectifier bridge of the type full wave rectifier, which consists of four rectifier diodes 11, 12, 13, 14. The two input connectors 15, 16 of the rectifier bridge is consequently connected into the conductor 7 and the two output connectors 17, 18 of the rectifier bridge are connected over the current valve 10 which consequently is arranged to control the current strength of the full wave rectified current passing between the two connectors 17, 18. The timing device 3 mentioned above consists of a timing circuit in the form of a capacitor 19 of for example 10 micro Farades and a resistor 20 of 100 ohms. In parallel with the timing curcuit 19, 20 a zener diode 21 is connected having a zener voltage of for example 24 V while a second zener diode 22 is connected in parallel with only the capacitor 19. The second zener diode 22 has a zener voltage of for example 8.2 V. Among the remaining components as an example a further resistor 23 of 100 ohms, a resistor 24 of 10 kohms, a resistor 25 of 1 meg ohms and a resistor 26 of 5 ohms can be mentioned. A filter 27 is connected in parallel with the power transistor 10 in order to protect the same against transients in the power supply. The filter 27 consists of a resistor 28 of for example 100 ohms and a capacitor 29 of 0.1 micro farades. In parallel with the load the capacitor 30 of for example 1 micro farade is connected.

Figure 3:
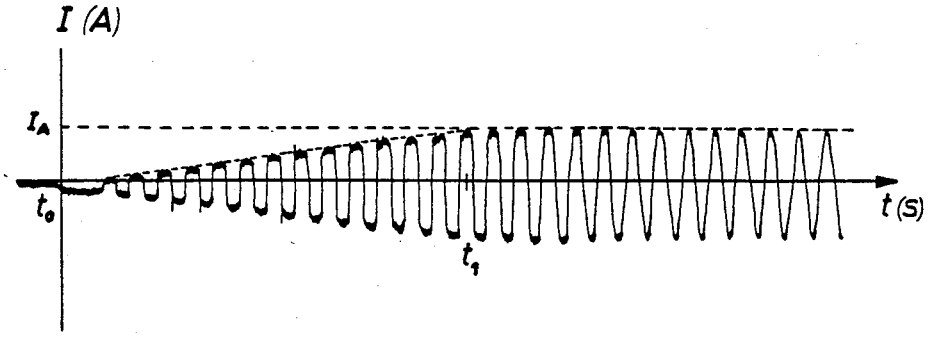
FIG. 3 shows a diagram over the current through the load.
Figure 4:
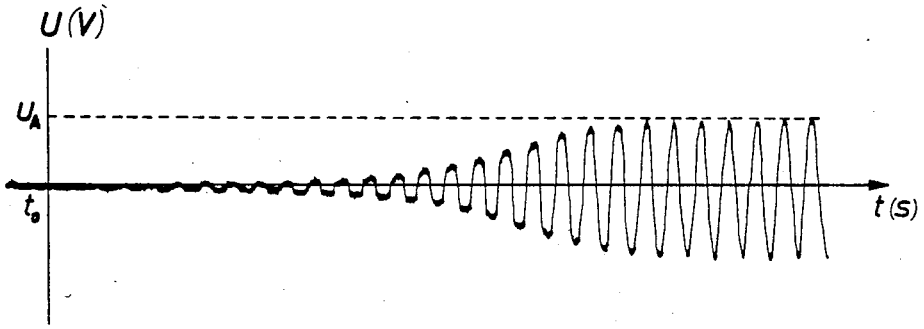
FIG. 4 shows the voltage in connection with switching on by means of the protection device according to the present invention.

When switching on the power supply by means of a switch, connecting an electric plug into a wall socket, which is connected to a power supply, the following occurs when the protection device according to FIG. 2 is connected to the feeding conductors 7, 8. The current valve 10 is so arranged that it in a resting condition, i.e. in a voltage free condition, is completely cut off, which involves that the current supply is interrupted through the load. After the switching-on moment which in FIGS. 3, 4 is represented by the cross point of the vertical axis with the horizontal time axis i.e. at the time $t_0$, the current valve starts to open for a successive increase of the current during a predetermined time interval from the time $t_0$ to the time $t_1$. The time interval as indicated is so chosen that the filament will be heated to such a temperature that the resistance has reached the resistance of a normal operating temperature. As mentioned above the resistance of a hot filament in a normal operating temperature is about ten times larger than the resistance in a cold condition, i.e. at for example room temperature. This has been stated by means of measuring the resistance at different lamp effects of 15 W to 150 W and it has been established that this relationship is valid with a surprisingly good accuracy. The chosen time interval can be chosen with a good margin, but not so far that any practical disadvantage arises by means of a delayed lightning. For example a time interval of about 50–500 ms can be chosen. From FIG. 3 it is apparent that the current strength through the filament of the lamp during this interval the whole time is maintained below a normal operating current $I_A$ and increases during this interval substantially linearly with respect to the amplitude. This successive increase in the amplitude takes place independent of where on the sinus curve the switching on takes place. By means of the un-linearity with respect to the resistance a more slow increase of the voltage takes place, which is apparent from FIG. 4.

In connection with switching on the power supply a delay in the increase of the current to a full operating current $I_A$ occurs by the action of the time circuit 19, 20 because of the necessary load time for loading the capacitor 19 whereby the zener diodes 21, 22 provide for that loading occurs only to a certain maximal control voltage. The resistor 26 provides further that the power transistor 10 cannot be controlled to damaging current level in connection with for example a short circuit of the filament. This occurs by the fixed bias voltage at one main electrode of the current valve determined by the zener 22, is reduced as a result of the fact that the voltage over the resistor 26 is increased when the current through the filament of the lamp increases, resulting in that the current valve gradually is choked.

By this slow current- and voltage increase the lamp will consequently be protected from the detrimental surge current, involving that the protecting device gives the lamp a considerably increased life time.

Figure 5:
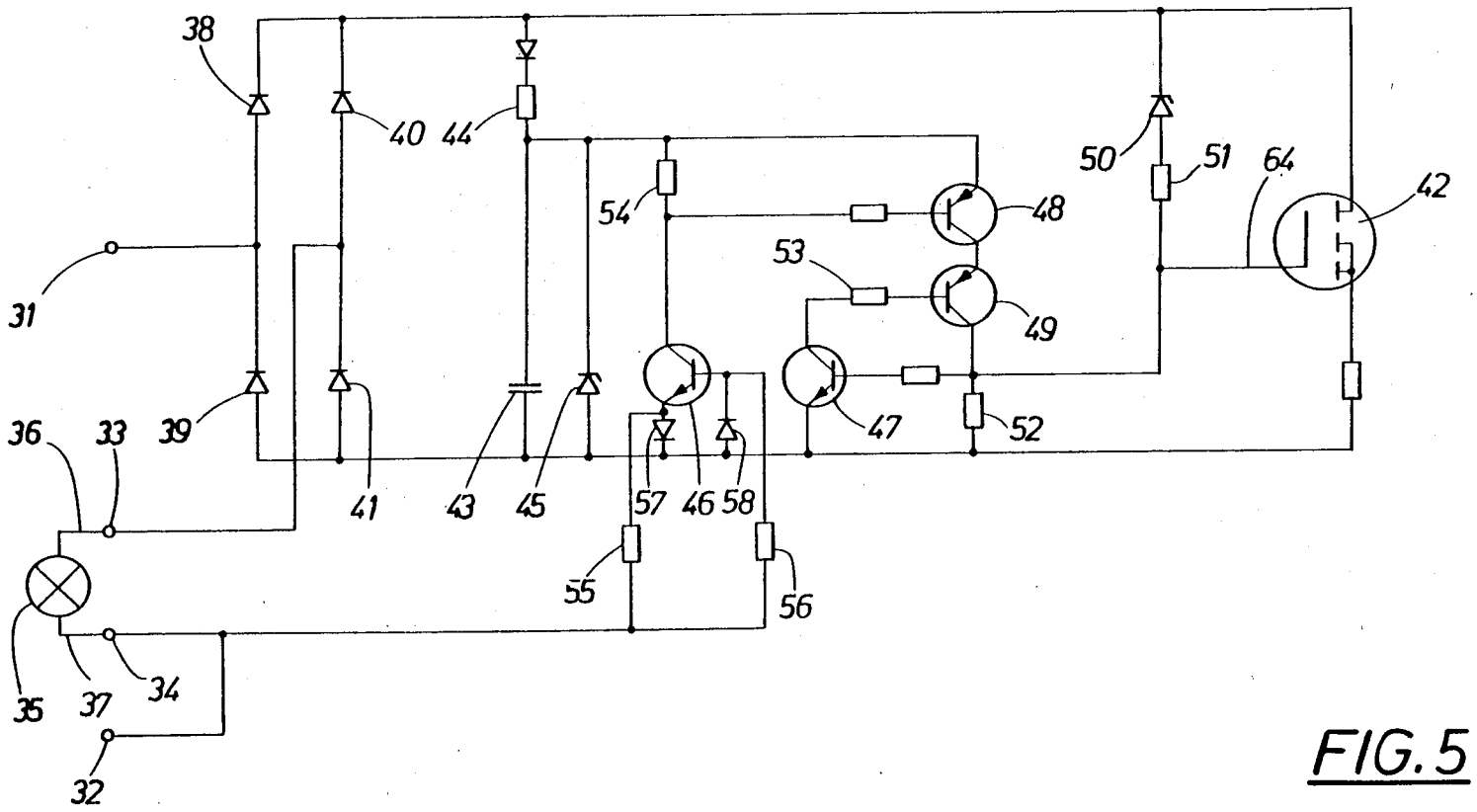
FIG. 5 shows the protection device in a third embodiment.

By means of the embodiment shown in FIG. 5 a further increased life time of the lamp is obtained by means of the fact that the protecting device is provided with means for reduction of the power supply to the load also after the switching-on period. The device has two input connectors 31, 32 for connection to an alternating current supply of for example 220 V. Further the device has two output connectors 33, 34 for connection of the conductor 36, 37 of the lamp 35. The protection device has also a rectifying bridge consisting of four diodes 38, 39, 40, 41. The protecting device further encloses a current valve 42 for controlling the current strength through the load 35. The control of the current through the load occurs by controlling the current valve, which for example consists of a field effect transistor, by means of control circuits. Said curcuits include a timing curcuit with a capacitor 43 and a resistor 44. A zener diode 45 is connected in parallel with the capacitor 43 in order to prevent an overvoltage at the control electrode 46 of the current valve 42. Four transistors 46, 47, 48, 49 are included in the control circuit by means of which the voltage of the control electrode 41 and the current through the current valve 42 and the load 35 is controlled. A further zener diode 50 is included in the means reducing the power over the load 35 also after the switching-on period.

Figure 7:
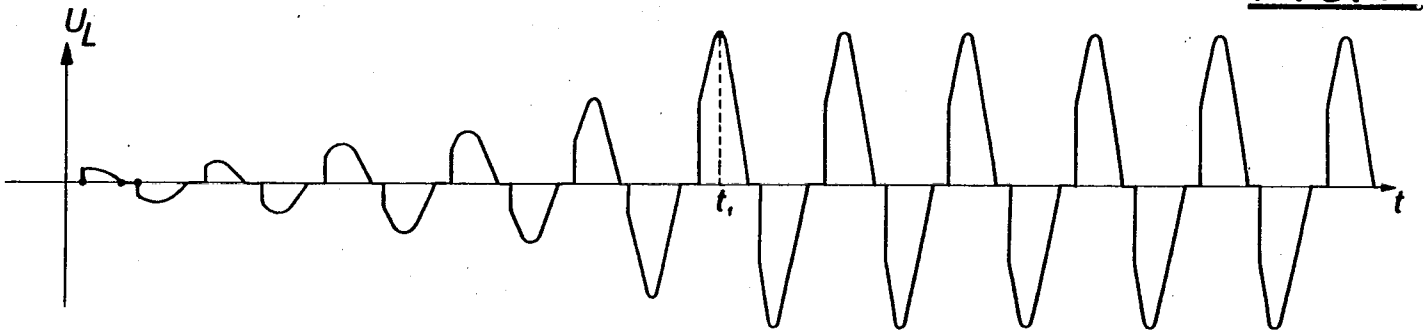
FIGS. 7 and 8 show diagrams over the wave form of voltage and current at the incandescent lamp which is to be protected.
Figure 8:
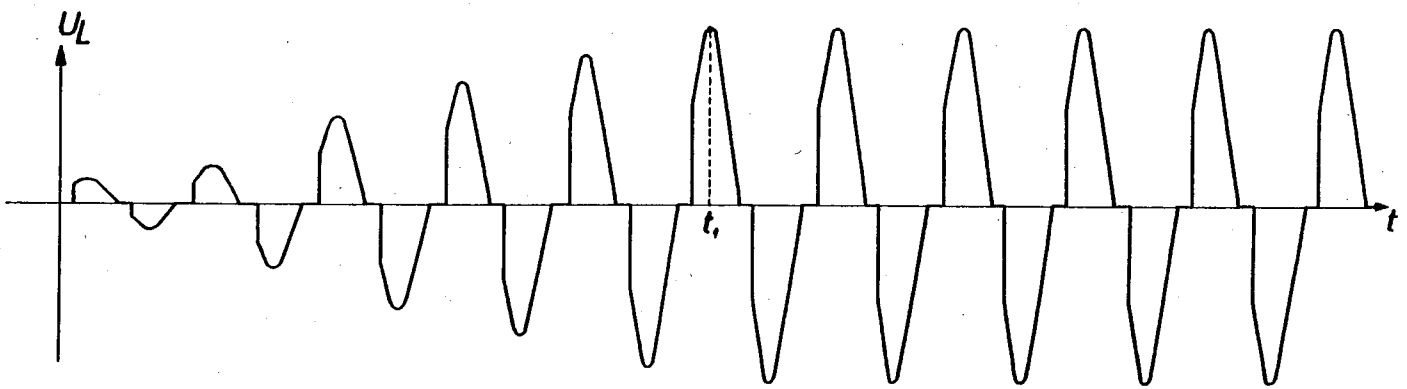

When switching on the light the capacitor 43 in the timing circuit is loaded to the voltage determined by means of the zener diodes 45. The speed of the loading depends on the time constant of the timing circuit 44, 45. By means of the timing circuit the above described delay of the increase of the current occurs during the time interval up to the time $t_1$. It is apparent from FIG. 8, which shows the increase of the alternating current from the switching on movement up to the time $t_1$. FIG. 7 shows that the voltage over the load 35 in a corresponding manner increases slowly from the switching-on moment. From FIGS. 7 and 8 it is also apparent how the reduction of the power is accomplished by cutting-off the alternating current in connection with every pass of the zero line and up to a chosen voltage level. The voltage level at which the alternating current is cut is determined by means of the zener diode 50 and when it's zener voltage of for example 100 V is exceeded, the transistor 49 and also the current valve 42 is made conductive. The zener diode 50, the resistor 51 and 52 and the resistor 53 determine by means of the transistor 47 and 49 when the current valve 42 is allowed to conduct. The current valve 42 is by means of the transistor 48 kept conductive until the zero line is passed by means of the resistor 54, 55, 56, the transistors 46, 48 and the diodes 57, 58, said components comprising a memory circuit.

Figure 9:
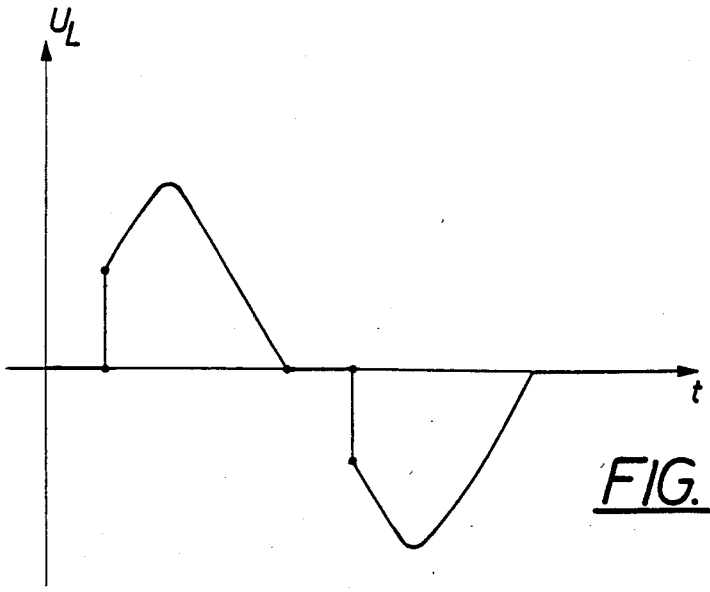
FIG. 9 shows a part of FIG. 10 in a larger scale and FIG. 10 shows the corresponding part of the voltage in the embodiment according to FIG. 6.

FIG. 9 shows in larger scale a part of the curve form according to FIG. 7 showing the changes by time of the voltage over the load.

Figure 6:
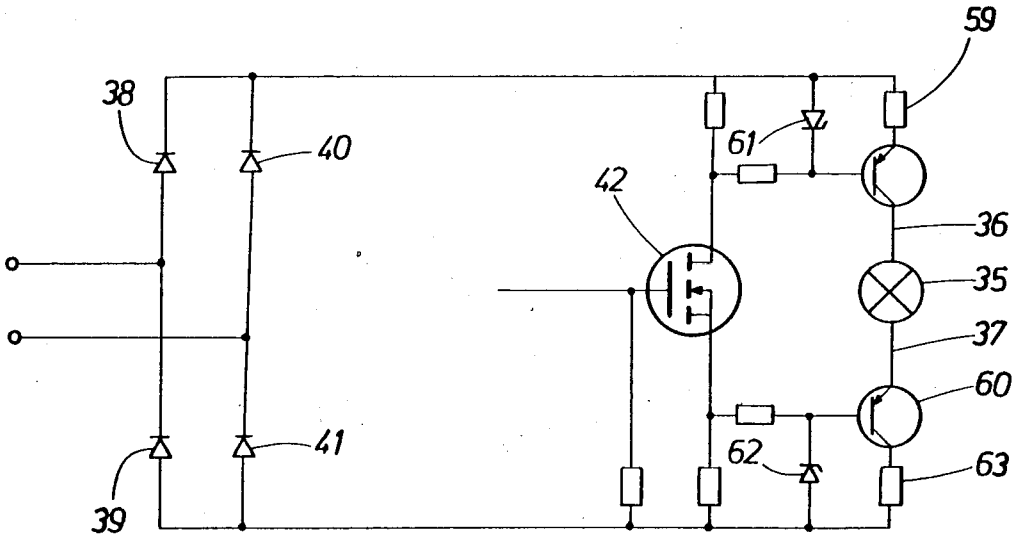
FIG. 6 shows the protection device in a fourth embodiment.
Figure 10:
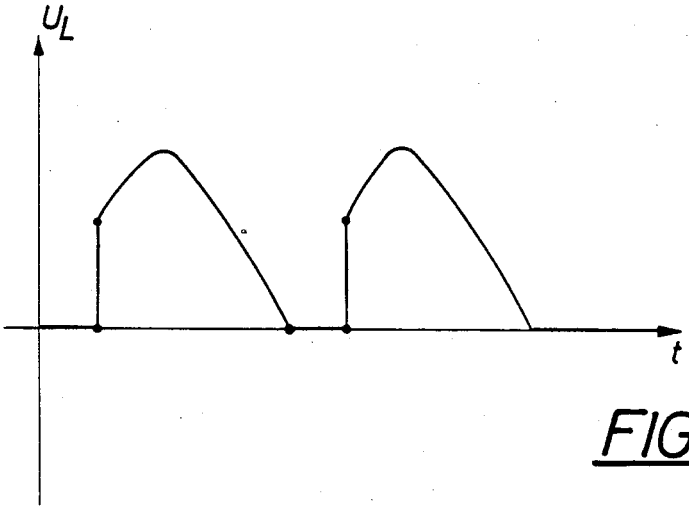

The embodiment shown in FIG. 6 utilizes substantially the same principal as the previous embodiments, but is modified in certain respects. The device has a rectifying bridge, consisting of four rectifying diodes 38, 39, 40, 41 as in the embodiment according to FIG. 5, but contrary to said embodiment the load is so connected, that the load current is full wave rectified and has a form which is shown in FIG. 10. The control circuits positioned between the rectifying bridge and the current valve 42 according to FIG. 5 are also included in this embodiment according to FIG. 6, but has been excluded in the drawing for the sake of clarity. Further two power transistors 59, 60 and zener diodes 61, 62 for each of the power transistors 59, 60 have been added. The two power transistors 59, 60 are consequently two further current valves, which are controlled by means of the changes in the conducting state of the first current valve 42. By the arrangement of current valves on both sides of the load, i.e. the lamp 35, an improved contact protection is obtained by the fact that a cut off of the two current valves 59, 60 will occur in connection with unnormal conditions and then the two conductors 36, 37 of the lamp 35 will be isolated.

In connection with the embodiment according to FIG. 5 as well as the embodiment according to FIG. 6 the load 35 will be protected against unnormal increase in the current strength, such as for example a short circuit over the load, which is accomplished by means of the control circuits as described above. This involves also certain contact protection in connection with short circuit, involving that the connecting points 33, 34 (see FIG. 5) are made voltage free in connection with a short circuit. Contact protection when having the lamp 35 removed, involving an infinite resistance, can for example take place by sensing the voltage over the resistor 63 by means of a sensing circuit not shown, which controls the current valve 42 in dependence of the voltage over the resistor 63. This curcuit can be made in a manner known per se.

Consequently, by means of the device according to the present invention a considerably prolonged life time of incandescent lamps are obtained by connecting the protection device according to the present invention between the power supply and one or several lamps. The prolongation of the life time can be made by on the one hand controlling the current at the switching-on period during a predetermined time interval, so that a gradual increase is obtained with respect to the amplitude of the voltage and current, and on the other hand by reduction of the supplied power to the load also after the switching on period, that is to say during the normal operating condition of the lamp. This reduction can be made up to approximately 15% of the total normal effect at full supply voltage without any observable reduction of the light strength of the lamp. Furthermore, by means of the present invention it can be accomplished a contact protection by interruption of the current supply to the lamp, when an unnormal resistance occurs at the connecting points for the load, for example the resistance zero, i.e. a short-circuit, or infinite resistance, i.e. damaged or removed lamp and consequently free connectors.

The protection device can be placed anywhere in an installation between the voltage power source and the load and can advantageously be positioned in a wall socket, a switch or a lamp holder. The protection device can be produced with a high degree of miniaturization for example an integrated circuit, a so called IC-circuit which can be included as standard component in the installation component. For example the IC-circuit can be moulded within the bottom portion of a lamp holder.

The invention is not limited to the embodiments described above and in the drawings but can be modified within the scope of the accompanying claims. For example the protection device can be utilized for other applications than electrical installations in buildings. For example the protection device can be built within vehicles and be positioned so that it simultaneously protects several lamps, for example be installed in fuse holders or similar. The coupling diagrams according to the shown examples can be designed in different manners. For example the timing circuit can be made in form of a device which senses the zero line and within the time interval $t_1$ so that a stepwise increase of the amplitude of the current takes place for each zero line. The reduction of power can be made by cutting off the current valve when attaining a chosen voltage level and by opening the current valve when passing the zero line.

We claim:

1. A protection device for an electrical incandescent lamp for operation at a prescribed operating voltage, including elements which upon switching on electric voltage limit the current strength during a switching-on interval, said device including a control unit with at least one controllable current valve and timing means for controlling the current through the lamp upon switching on so that a delayed increase of current is obtained from zero to a chosen operating current over a predetermined time interval while the voltage over the lamp during at least said time interval is below the operating voltage, and means for maintaining power to the lamp at a substantially constant level which is reduced by up to approximately 15% relative to the effect which is achieved at said prescribed operating voltage.

2. A protection device according to claim 1, wherein said power reduction is obtained by cutting off said current valve upon passing the voltage zero and by fully opening said valve upon achievement of a chosen voltage level.

3. A protection device according to claim 1, including load sensing means for controlling the current valve at an abnormal voltage and current through the lamp so that the current valve is cut off in order to interrupt current feed to the lamp.

4. A protection device according to claim 3, wherein said load sensing means is operable to sense that the current strength through the lamp is held within a predetermined interval, and to control the current valve so that the current feed to the lamp is interrupted when the current strength falls outside the interval.

* * * * *